US009393611B2

(12) United States Patent
Inoue

(10) Patent No.: US 9,393,611 B2
(45) Date of Patent: Jul. 19, 2016

(54) METHOD FOR REINFORCING DIE AND REINFORCED DIE

(71) Applicant: SODICK CO., LTD., Kanagawa (JP)

(72) Inventor: Motohiro Inoue, Kanagawa (JP)

(73) Assignee: SODICK CO., LTD., Kanagawa (JP)

( * ) Notice: Subject to any disclaimer, the term of this patent is extended or adjusted under 35 U.S.C. 154(b) by 0 days.

(21) Appl. No.: 14/855,362

(22) Filed: Sep. 15, 2015

(65) Prior Publication Data

US 2016/0074930 A1 Mar. 17, 2016

(30) Foreign Application Priority Data

Sep. 17, 2014 (JP) ..... 2014-189261

(51) Int. Cl.

| | |
|---|---|
| ***B21B 45/00*** | (2006.01) |
| ***B21J 13/02*** | (2006.01) |
| ***C23C 8/02*** | (2006.01) |
| ***B22D 17/20*** | (2006.01) |
| ***C23C 8/28*** | (2006.01) |

(52) U.S. Cl.

CPC ..... *B21J 13/02* (2013.01); *B22D 17/2007* (2013.01); *B22D 17/2038* (2013.01); *C23C 8/02* (2013.01); *C23C 8/28* (2013.01)

(58) Field of Classification Search

CPC ..... B21J 13/02; C23C 8/02; C23C 8/28; B22D 17/2038; B22D 17/2007

USPC ..... 72/47

See application file for complete search history.

(56) References Cited

U.S. PATENT DOCUMENTS

| | | | | |
|---|---|---|---|---|
| 9,022,093 | B2 * | 5/2015 | Shia | B22D 17/007 164/113 |
| 2016/0074930 | A1 * | 3/2016 | Inoue | B21J 13/02 72/462 |

FOREIGN PATENT DOCUMENTS

| | | |
|---|---|---|
| JP | 2008-138223 | 6/2008 |
| JP | 2009-262172 | 11/2009 |

* cited by examiner

*Primary Examiner* — David B Jones

(74) *Attorney, Agent, or Firm* — Jianq Chyun IP Office

(57) ABSTRACT

A method for reinforcing a die is described. A die material made of a high speed tool steel for hot dies including a matrix high speed tool steel, an alloy tool steel for hot dies or a stainless steel is irradiated as an irradiated object with a large-area electron beam so that a smooth surface modification layer of 2 to 5 μm in thickness is formed by elution of a contained substance in the die material. Then, the die material is subjected to a sulphonitriding treatment so that a sulfurized film having a thickness less than the thickness of the surface modification layer prior to the sulphonitriding treatment and containing the sulfur compound of the contained substance more than the sulfur compound of the main substance in the die material, and a diffusion layer of nitrogen and sulfur adjacent to the inner side of the sulfurized film are formed.

4 Claims, 5 Drawing Sheets

METHOD FOR REINFORCING DIE AND REINFORCED DIE

CROSS-REFERENCE TO RELATED APPLICATION

This application claims the priority benefit of Japan Application no. 2014-189261, filed on Sep. 17, 2014. The entirety of the above-mentioned patent application is hereby incorporated by reference herein and made a part of this specification.

BACKGROUND OF THE INVENTION

1. Field of the Invention

The invention relates to a method for reinforcing a die, which is based on a surface modification method using an electron beam, and a sulphonitriding treatment. Particularly, the invention relates to a method for reinforcing a die made of a high speed tool steel for hot dies including a matrix high speed tool steel, an alloy tool steel for hot dies, or a stainless steel, and to a reinforced die obtained with the method.

2. Description of the Related Art

A nitriding method or a carbide coating method is conventionally well-known as a method for reinforcing a die. In addition, a surface modification method is known in which a surface of an irradiated object is irradiated with an electron beam of low energy density that has an electron column having a relatively large cross-sectional area. Hereinafter, such method is simply called large-area electron beam irradiation. With the surface modification method utilizing large-area electron beam irradiation, a uniform fine crystal structure layer with no segregation, which cannot be obtained by polishing, is formed on a surface of a metal material.

A typical structure of an electron beam surface modification apparatus that performs large-area electron beam irradiation is disclosed in, e.g., Patent Document 1. Specifically, in the surface modification method utilizing large-area electron beam irradiation, after a chamber is pressure-reduced to a nearly vacuum state, an argon gas is dispersed at a low concentration, and while the argon gas is converted into plasma, accelerated electrons pass through the plasma region at high speed to collide with the irradiated object. The surface of the irradiated object is melted due to the impact and the sharp temperature rise caused by the collision between the electrons and the irradiated object, and the contained substance is eluted on the surface due to heat and surface tension and then re-solidify. Thereby, the surface gets smoother. Moreover, the contained substance is one or more chemical substances added to a die material to provide specific properties.

In the surface modification method utilizing large-area electron beam irradiation that intermittently irradiates a low-energy-density electron beam for about 2 μsec, only a portion of the irradiated object from the surface to a depth of 2 to 5 μm is increased in temperature, and the portion at a larger depth is not melted. Therefore, even if a high-energy electron beam is repeatedly irradiated several times, the shape of the irradiated object is unlikely to collapse, and the entire irradiated surface of the irradiated object is uniformly modified, so that a high quality smooth surface having excellent durability is obtained.

Patent Document 2 discloses a method for reinforcing a die in which a die material as the irradiated object is repeatedly irradiated with a large-area electron beam in a short time to obtain a uniform re-solidified layer and is then subjected to nitriding or carbide coating. With the invention of Patent Document 2, the strength of the die can be improved.

A surface of a die formed by surface modification utilizing large-area electron beam irradiation followed by nitriding has durability and abrasion resistance from the modification utilizing large-area electron beam irradiation, and has durability from the hardening due to the nitride compounds generated by the nitriding treatment. However, how strongly a nitride layer being a layer of nitrogen compounds bonds with a bonding surface is uncertain.

Naturally, in the nitriding treatment, since the nitride layer and a diffusion layer of nitrogen are formed in a thickness of at least a few tens of micrometers, small cracks, so-called "thermal cracks," are likely to be caused by compressive residual stress that acts on the nitride layer, and there is a fear that the nitride layer having thermal cracks may fall off from the surface of the die. For this reason, although the resistance is increased and durability is improved during the time the surface modification layer is maintained, if the die is continuously used for long time, the surface modification layer will be rapidly lost at a certain time point so that partial peel-off of the surface layer or damage to a curved portion or a corner portion is likely to occur.

PRIOR-ART DOCUMENTS

Patent Documents

Patent Document 1: JP 2009-262172 A
Patent Document 2: JP 2008-138223 A

SUMMARY OF THE INVENTION

Accordingly, the invention provides a novel die reinforcing method that extends the life of a die having corrosion resistance and durability, and a reinforced die. Several advantages that can be obtained by the invention are more specifically described in the description of the embodiments.

The die reinforcing method of the invention is characterized by the followings. A die material made of a high speed tool steel for hot dies including a matrix high speed tool steel, an alloy tool steel for hot dies or a stainless steel is irradiated as an irradiated object with a large-area electron beam to form a smooth surface modification layer of 2 to 5 μm in thickness by elution of a contained substance in the die material. Then, the die material is subjected to a sulphonitriding treatment to form a sulfurized film having a thickness less than the thickness of the surface modification layer prior to the sulphonitriding treatment and containing the sulfur compound of the contained substance more than of the sulfur compound of the main substance in the die material, and a diffusion layer of nitrogen and sulfur adjacent to the sulfurized film.

The reinforced die of the invention, which is based on, as a die material, a high speed tool steel for hot dies including a matrix high speed tool steel, an alloy tool steel for hot dies or a stainless steel, is characterized by the following. The reinforced die includes, on the surface, a sulfurized film and a diffusion layer of nitrogen and sulfur formed adjacent to an inner side of the sulfurized film, wherein the sulfurized film is formed by irradiation with a large-area electron beam to obtain a smooth surface modification layer of 2 to 5 μm in thickness by elution of the contained substance in the die material, and a subsequent sulphonitriding treatment, such that the sulfurized film contains the sulfur compound of the contained substance more than the sulfur compound of the main substance in the die material and has a thickness less than the thickness of the surface modification layer prior to the sulphonitriding treatment.

Due to the large-area electron beam irradiation, the contained substance in the die material as the irradiated object is eluted to cover the surface of the die material. At this moment, the nature of the surface modification layer formed at the surface generally depends upon the nature of the contained substance that is eluted and dispersed. For example, if the eluted contained substance is chromium, a die having a corrosion-resistant surface layer is obtained. If the die having the surface layer modified by large-area electron beam irradiation is subjected to nitriding, nitrogen bonds with the contained substance of the surface modification layer in the surface layer to form nitrides and harden, so that a die having high impact resistance and durability is obtained.

In the die reinforcing method of the invention, when the die is impregnated with nitrogen and sulfur by a sulphonitriding treatment subsequent to the surface modification utilizing large-area electron beam irradiation, a sulfurized film of about 1 μm is formed on the surface layer. At this moment, the extremely thin sulfurized film of only about 1 μm that is formed by bonding the contained substance uniformly dispersed in the surface modification layer in the surface layer with sulfur mainly contains a larger proportion of the sulfur compound of the contained substance and has a relatively low content of iron sulfide.

Hence, the sulfurized film has abrasion resistance and corrosion resistance, and the bonding force of the sulfurized film itself is relatively strong. In addition, due to the effect of the surface modification layer formed before the sulphonitriding treatment and of the contained substance, a nitrogen compound and a sulfur compound are unlikely to be formed in an inner layer, so that a diffusion layer in which nitrogen and sulfur uniformly disperse and permeate is formed adjacent to the surface modification layer in the surface layer, nearly without including a nitride layer or a sulfide layer being a layer of the sulfur compound.

Since nearly no nitride layer or sulfide layer is formed in the inner layer, generation of thermal cracks is suppressed to a greater extent. Also, it is assumed that in the sulfurized film, the bonding force by means of the sulfur compound of the contained substance is improved and that bonding force between the sulfurized film and the diffusion layer of nitrogen and sulfur is reinforced, so that the surface layer is more unlikely to peel from the inner layer.

As a result, not only the strength is improved by the surface modification and the hardening by the nitriding, but also sliding resistance is reduced by the sulfurized film and the heat generation by sliding can be suppressed. Therefore, the risk of seizure can be reduced. Even if thermal cracking occurs, the thermal cracks are unlikely to reach the sulfurized film. Fall-off or peel-off of the surface layer of the die can be more reliably suppressed, and the sulfurized film is maintained for long time. Accordingly, the lifetime of the die is extended.

In order to make the aforementioned and other objects, features and advantages of this invention comprehensible, a preferred embodiment accompanied with figures is described in detail below.

DESCRIPTION OF THE EMBODIMENTS

Figure 1:
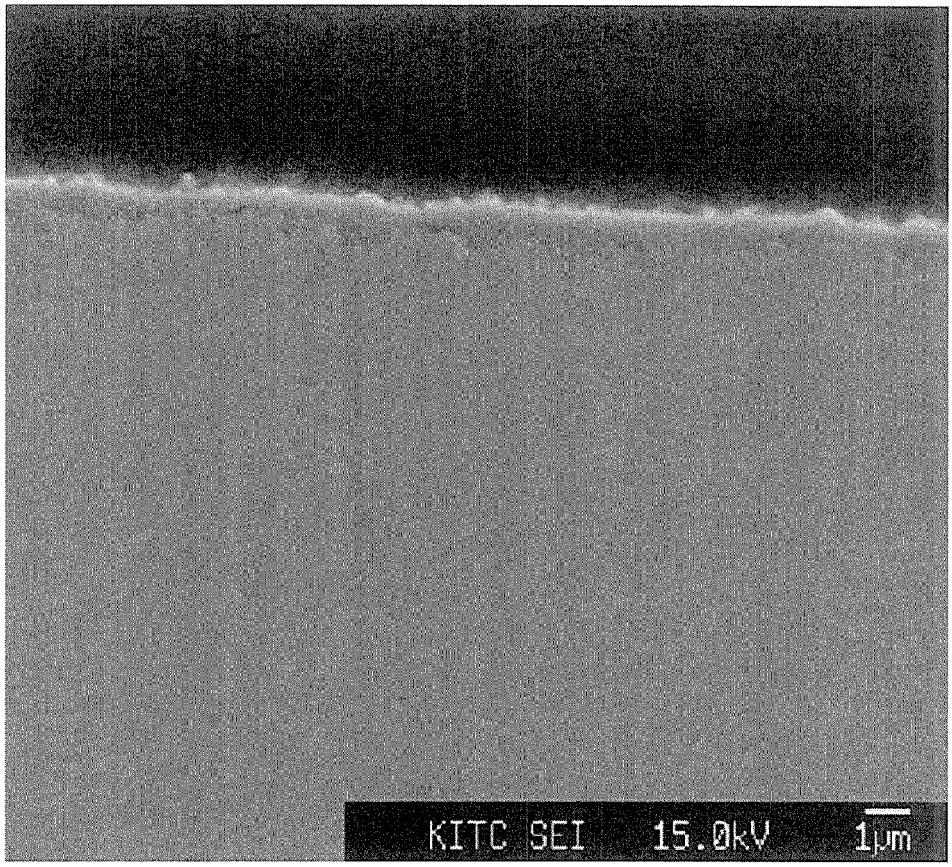
FIG. 1 is a picture of a cross section of a surface of an exemplary reinforced die of the invention.
Figure 2:
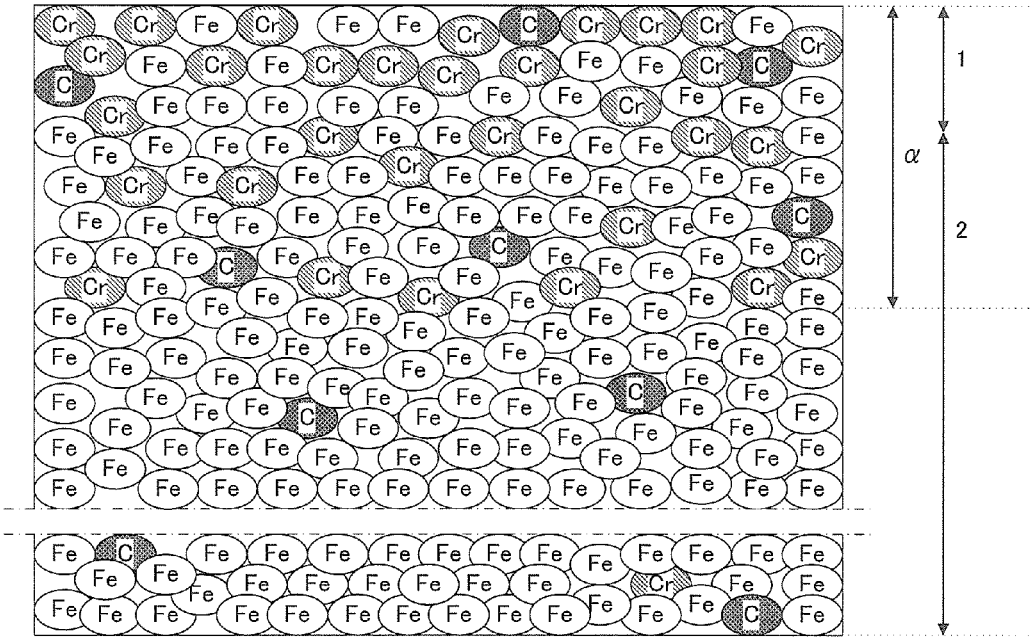
FIG. 2 is a schematic diagram showing a state of substances in a cross section of an exemplary die of the invention during the surface modification.
Figure 3:
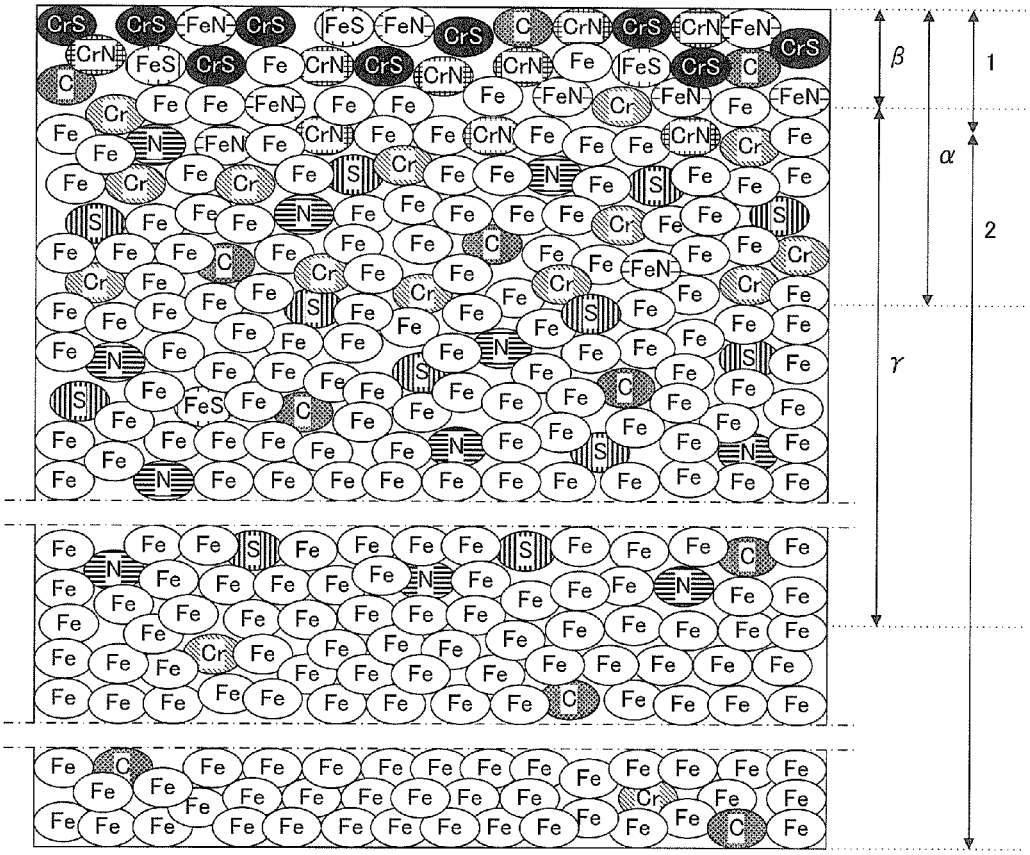
FIG. 3 is a schematic diagram showing a state of substances in a cross section of the exemplary die of the invention during a sulphonitriding treatment.

The method for reinforcing die and the reinforced die of the invention as shown in FIG. 1 are described below with reference to FIG. 2 and FIG. 3 accordingly. FIG. 3 illustrates a cross section of a die according to an embodiment of the invention, wherein the surface of a die material made of a matrix high speed tool steel is subjected to large-area electron beam irradiation and then to a sulphonitriding treatment so that a sulfurized film β is formed in the surface layer 1 and a diffusion layer γ of nitrogen and sulfur is formed adjacent to the sulfurized film β.

In an exemplary process for forming the above structure, first, a chamber in which an irradiated object is disposed is vacuumed by a vacuum pump, and an argon gas is introduced in the chamber to reduce the pressure in the chamber to 0.05 Pa. Next, a cathode electrode of 60 mmϕ in diameter is used, the cathode voltage is set to 28 kV, the anode voltage is set to 5 kV, and the solenoid voltage is set to 1.5 kV. A magnetic field is formed by the solenoid, and while the argon gas in the anode electrode is converted into plasma, the irradiated object is irradiated by an electron beam. The irradiation with the electron beam is intermittently and repeatedly performed until a smooth surface of 2 to 5 μm in thickness is obtained.

An alloy die as the irradiated object in the embodiment is a die for hot forging. Specifically, YXR3 produced by Hitachi Metals Tool Steel, Ltd. being a matrix high speed tool steel may be used. In a die reinforcing method of the invention, the following materials are confirmed to have proper effects as the alloy for the die material: high speed tool steels for hot dies from which chromium is eluted, such as SKH; alloy tool steels for hot dies from which molybdenum and chromium are eluted, such as SKD61; and stainless steels from which cobalt is eluted, such as SUS. In addition, in the surface modification method utilizing large-area electron beam irradiation, cemented carbide from which cobalt is eluted is confirmed to have excellent effects. Moreover, SKH, SKD61 and SUS are standards of steel materials defined by the Japanese Industrial Standards.

Next, the die material in which the smooth surface layer 1 is formed by the contained substance that is eluted due to the large-area electron beam irradiation is subjected to a sulphonitriding treatment. If a matrix high speed tool steel is used, a chromium layer of about 3 μm is formed on the surface of the die. At this moment, the thickness of the sulfurized film β formed on the surface of the die is about 1 μm. The thickness of the sulfurized film β may be 1 μm or greater, but does not exceed the thickness of the surface modification layer α prior to the sulphonitriding treatment.

In the method of this embodiment, a specific process can be set by according to the variation in the state of the surface of the die. As shown in FIG. 2, a process of obtaining a surface modification layer α of the contained substances by large-area electron beam irradiation is to elute the contained substance in a manner such that the contained substance is widely and uniformly spread. In the embodiment, chromium is widely and uniformly dispersed throughout the surface of the die.

Next, the surface of the die on which the surface modification layer α has been formed is subjected to the sulphonitriding treatment. As shown in FIG. 3, the sulfurized film β of about 1 μm that mainly contains a larger proportion of sulfur compounds of the contained substance is formed on the surface. In addition, in the surface modification layer α, due to the wide and uniform dispersion of the contained substance, nitrogen is more likely to bond with the contained substance, and a nitride compound composed of nitrogen and the contained substance is generated in a greater proportion compared to the case of a conventional nitriding treatment. In the die of the embodiment, a larger amount of chromium nitride (CrN) is generated. Moreover, "Fe" in FIG. 3 represents iron nitrides including $Fe_2N$, $Fe_3N$ and $Fe_4N$.

Figure 4:
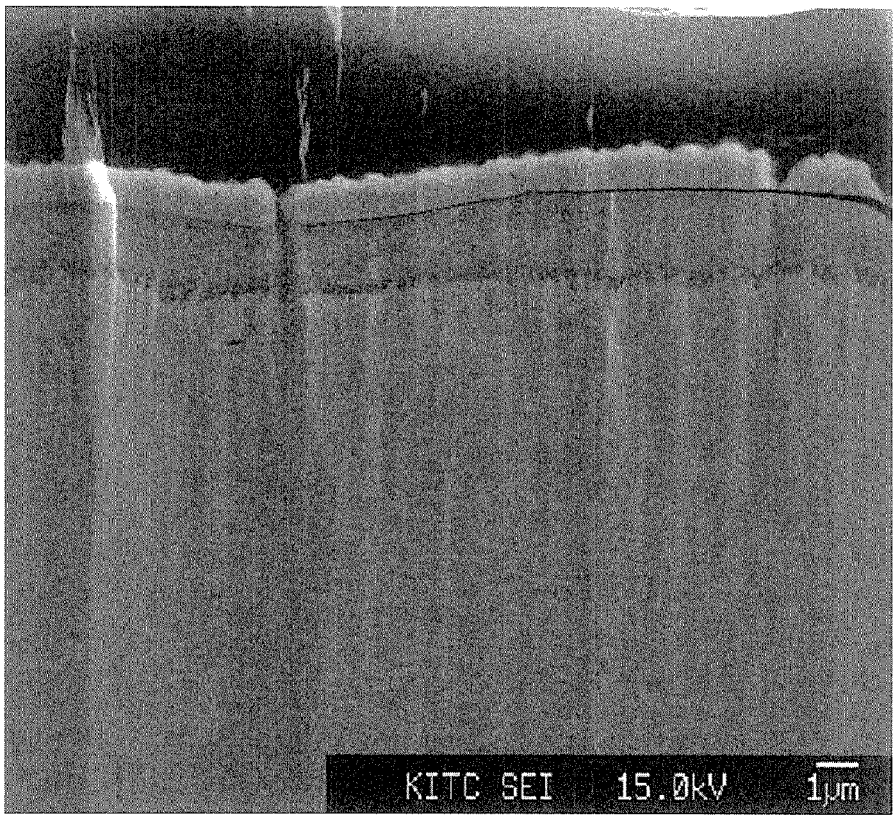
FIG. 4 is a picture of a cross section of the surface of a die after the sulphonitriding treatment is performed on a polished surface.

In the reinforcing method of the embodiment, at the same time as the formation of the sulfurized film β, the diffusion layer γ of nitrogen and sulfur of about a few tens of μto 100 μm in thickness is formed under the sulfurized film β in a manner such that nearly no nitride compound or sulfide compound of the contained substance or iron being the main substance is contained in the diffusion layer γ. Since the surface modification layer α has corrosion resistance and a larger amount of chromium bonds with sulfur in the surface layer 1, there is a possibility that a diffusion speed of nitrogen and sulfur to an inner layer 2 is slowed down and generation of nitride compounds and sulfide compounds in the diffusion layer γ is suppressed. In a general sulphonitriding treatment performed on a polished surface, as shown in FIG. 4, if a matrix high speed tool steel is used, for example, a nitride layer and a sulfide layer of about 25 μm in thickness are formed, respectively containing a large amount of iron nitride and iron sulfide, and respectively containing chromium nitride and chromium sulfide.

FIG. 1 illustrates a cross section of an exemplary die in which the sulfurized film β and the diffusion layer γ were obtained by the reinforcing method of this embodiment. FIG. 4 illustrates a cross section of a die formed by the above general sulphonitriding treatment. By comparing FIG. 1 and FIG. 4, it is clear that in the die of the invention, a nitride layer and a sulfide layer that are formed by the general sulphonitriding treatment do not exist, but the diffusion layer γ in which nitrogen and sulfur uniformly disperse was formed. In addition, it is known that in the die of the invention, the sulfurized film β is formed in a thickness of only about 1 μm that is less than in the general sulphonitriding treatment, and the sulfurized film β is obtained by bonding sulfur compounds together in a high density so as to be uniform and smooth. Moreover, the thickness of the diffusion layer γ of nitrogen and sulfur in the die of the invention shown in FIG. 1 is about 25 μm.

Figure 5:
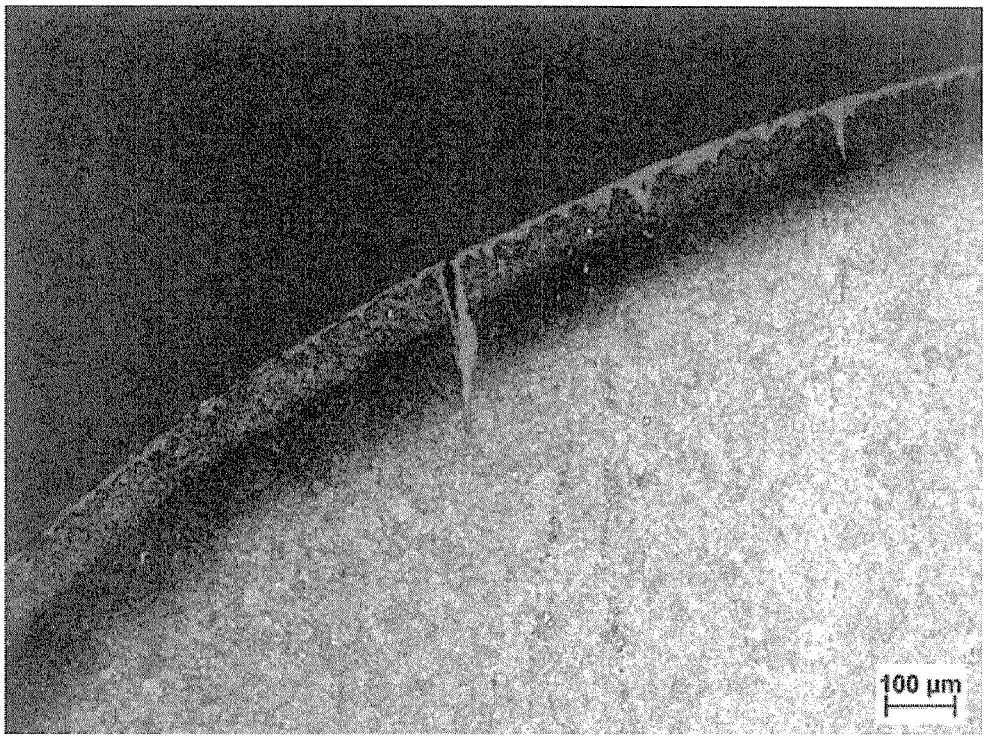
FIG. 5 is a picture of a cross section showing a state of an exemplary reinforced die of the invention after being used a predetermined number of times.

FIG. 5 illustrates a cross section of an exemplary die in which the sulfurized film β and the diffusion layer γ were obtained by the reinforcing method of this embodiment, in a state where the die has been used 10000 times. Due to the long-term use, thermal cracking occurred in the diffusion layer γ of nitrogen and sulfur, while the sulfurized film β did not rupture by its bonding force such that the surface abrasion resistance was maintained.

Moreover, in the die of the embodiment, a residual tensile stress is generated in the surface modification layer α due to the large-area electron beam irradiation. In addition, during the sulphonitriding treatment, a compressive residual stress is generated as nitrogen bonds with iron and chromium due to impregnation with nitrogen. The compressive residual stress cancels out the tensile residual stress in the surface modification layer α to suppress occurrence of distortion caused by residual stress generated in the surface layer 1. Hence, the lifetime of the die is further increased.

This invention has been disclosed above in the preferred embodiments, but is not limited to those. It is known to persons skilled in the art that some modifications and innovations may be made without departing from the spirit and scope of this invention. Hence, the scope of this invention should be defined by the following claims.

What is claimed is:

1. A method for reinforcing a die, comprising:

irradiating a die material made of a high speed tool steel for hot dies comprising a matrix high speed tool steel, an alloy tool steel for hot dies or a stainless steel as an irradiated object with a large-area electron beam to form a smooth surface modification layer of 2 to 5 μm in thickness by elution of a contained substance in the die material; and subjecting the die material in which the surface modification layer is formed to a sulphonitriding treatment, so as to form a sulfurized film having a thickness less than the thickness of the surface modification layer prior to the sulphonitriding treatment and containing a sulfur compound of the contained substance more than a sulfur compound of a main substance in the die material and, adjacent to the sulfurized film, a diffusion layer of nitrogen and sulfur.

2. The method of claim 1, wherein the thickness of the sulfurized film is about 1 μm.

3. A reinforced die, being based on, as a die material, a high speed tool steel for hot dies comprising a matrix high speed tool steel, an alloy tool steel for hot dies or a stainless steel, and comprising, on a surface thereof:

a sulfurized film, formed by irradiation with a large-area electron beam to obtain a smooth surface modification layer of 2 to 5 μm in thickness by elution of a contained substance in the die material, and a subsequent sulphonitriding treatment, wherein the sulfurized film contains a sulfur compound of the contained substance more than a sulfur compound of a main substance in the die material, and the sulfurized film has a thickness less than the thickness of the surface modification layer prior to the sulphonitriding treatment; and a diffusion layer of nitrogen and sulfur, formed adjacent to an inner side of the sulfurized film.

4. The reinforced die of claim 3, wherein the thickness of the sulfurized film is about 1 μm.

* * * * *